US008439075B2

(12) United States Patent
Lin

(10) Patent No.: US 8,439,075 B2
(45) Date of Patent: May 14, 2013

(54) OUTLET OF A SPIGOT

(76) Inventor: Chen-Chang Lin, Shengang Township, Taichung County (TW)

( * ) Notice: Subject to any disclaimer, the term of this patent is extended or adjusted under 35 U.S.C. 154(b) by 361 days.

(21) Appl. No.: 12/799,944

(22) Filed: May 5, 2010

(65) Prior Publication Data

US 2011/0272050 A1 Nov. 10, 2011

(51) Int. Cl.
*B05B 1/00* (2006.01)

(52) U.S. Cl.
USPC ..... 137/801; D23/238; D23/255

(58) Field of Classification Search .. 239/601; D23/238, D23/255; 137/359, 360, 801
See application file for complete search history.

(56) References Cited

U.S. PATENT DOCUMENTS

D341,875 S * 11/1993 Allen et al. ..... D23/238
D404,471 S * 1/1999 Esche et al. ..... D23/255
D424,664 S * 5/2000 Green et al. ..... D23/255
D473,928 S * 4/2003 Lord et al. ..... D23/238
D580,016 S * 11/2008 Downey ..... D23/238
D597,631 S * 8/2009 Mourani ..... D23/238
D620,564 S * 7/2010 Yokoyama et al. ..... D23/255

* cited by examiner

*Primary Examiner* — John K Fristoe, Jr.
*Assistant Examiner* — Angelisa Hicks
(74) *Attorney, Agent, or Firm* — William E. Pelton, Esq.; Cooper & Dunham LLP

(57) ABSTRACT

An outlet of a spigot has a bottom seat, a neck, a head and a flow passage. The bottom seat has a flat bottom face. The neck is curvedly formed on and protrudes upward from the bottom seat. The head is formed on and protrudes forward from the neck and has a front side. The flow passage is formed in the outlet between the bottom seat, the neck and the head and has an inlet hole and an outlet hole. The inlet hole is formed through the bottom face of the bottom seat and communicates with the flow passage. The outlet hole is formed through the front side of the head and communicates with the flow passage and has a width and a length. The length of the outlet hole is wider than the width of the outlet hole.

2 Claims, 7 Drawing Sheets

OUTLET OF A SPIGOT

BACKGROUND OF THE INVENTION

1. Field of the Invention

The present invention relates to an outlet of a spigot, and more particularly to an outlet of a spigot that can provide a preferred cleaning effect.

2. Description of Related Art

A conventional spigot is mounted on a washbasin to spray water out from an outlet to allow a user to washing hands or objects.

The shape of the outlet of the conventional spigot may be circular or flat, so the water column sprayed out from the outlet is also circular or flat. However, the circular or flat water column cannot meet the requirement of washing a long object, such as hands and may decrease washing efficiency. In addition, the water column may spray everywhere when the water pressure is increased and this wastes water.

The invention provides an outlet of a spigot that mitigates or obviates the aforementioned problems.

SUMMARY OF THE INVENTION

The main objective of the present invention is to provide an outlet of a spigot that can provide a preferred cleaning effect.

The outlet of a spigot in accordance with the present invention has a bottom seat, a neck, a head and a flow passage. The bottom seat has a flat bottom face. The neck is curvedly formed on and protrudes upward from the bottom seat. The head is formed on and protrudes forward from the neck and has a front side. The flow passage is formed in the outlet between the bottom seat, the neck and the head and has an inlet hole and an outlet hole. The inlet hole is formed through the bottom face of the bottom seat and communicates with the flow passage. The outlet hole is formed through the front side of the head and communicates with the flow passage and has a width and a length. The length of the outlet hole is wider than the width of the outlet hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
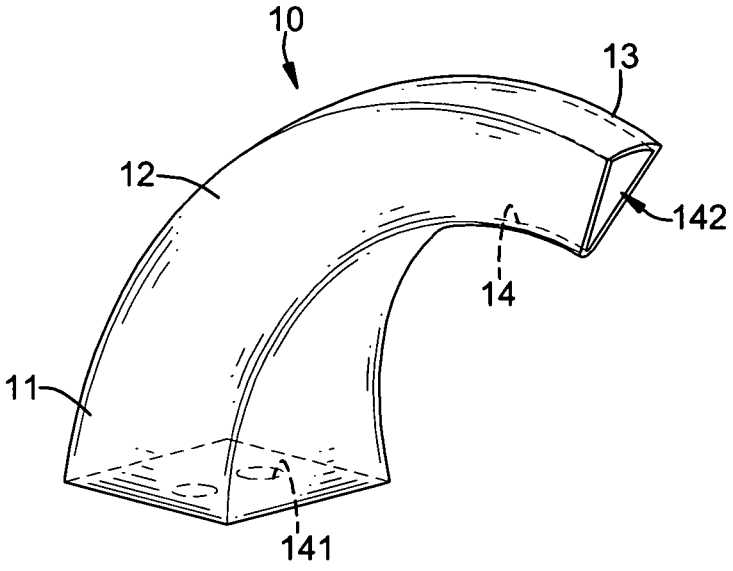
FIG. 1 is a perspective view of a first embodiment of an outlet of a spigot in accordance with the present invention.
Figure 4:
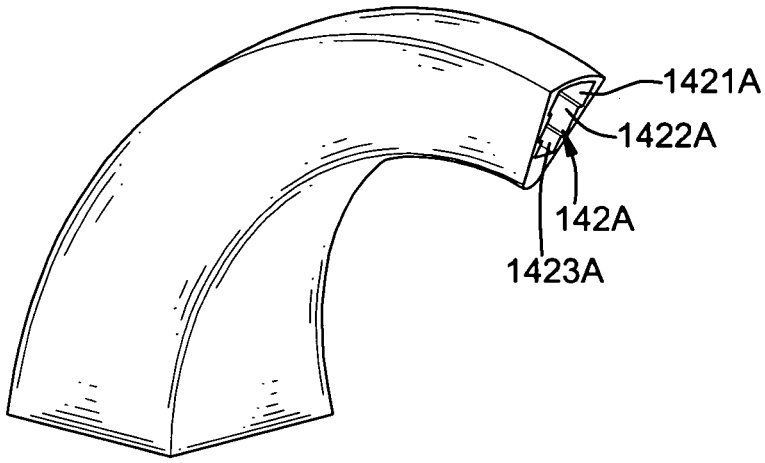
FIG. 4 is a perspective view of a second embodiment of an outlet of a spigot in accordance with the present invention.
Figure 6:
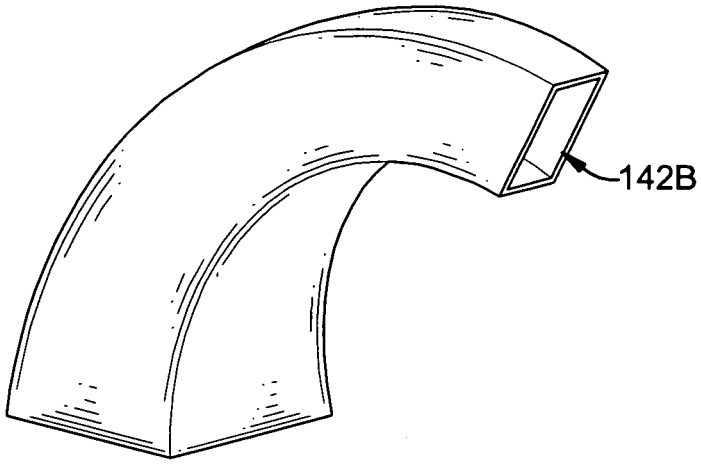
FIG. 6 is a perspective view of a third embodiment of an outlet of a spigot in accordance with the present invention.

With reference to FIGS. 1, 4 and 6, an outlet (10) of a spigot in accordance with the present invention comprises a bottom, a bottom seat (11), a neck (12), a head (13) and a flow passage (14).

The bottom seat (11) may be quadrate, is formed on the bottom of the outlet (10) and has a flat bottom face with four sides. The neck (12) is curvedly formed on and protrudes upward from the bottom seat (11) and has a top face, two sidewalls and a bottom face. The top face is formed on and protrudes from one of the sides of the flat bottom face of the bottom seat (11). The sidewalls are respectively formed on and protrude from two of the sides of the flat bottom face of the bottom seat (11), are formed with the top face of the neck (12) and face to each other. The bottom face is formed on and protrudes from the other side of the flat bottom face of the bottom seat (11), is formed with the sidewalls of the neck (12) and is opposite to the top face of the neck (12). The head (13) is formed on and protrudes forward from the neck (12) and has a front side formed with the top face, the sidewalls and the bottom face of the neck (12).

The flow passage (14) is formed in the outlet (10) between the bottom seat (11), the neck (12) and the head (13) and has at least one inlet hole (141) and an outlet hole (142, 142A, 142B). The inlet hole (141) is formed through the bottom face of the bottom seat (11) and communicates with the flow passage (14).

Figure 2:
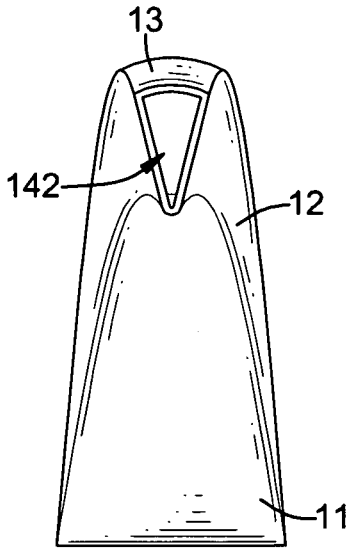
FIG. 2 is a front view of the outlet of a spigot in FIG. 1.
Figure 5:
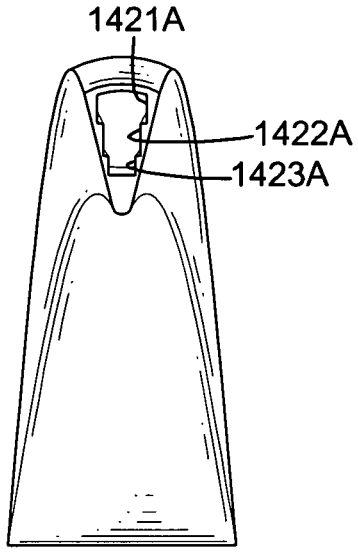
FIG. 5 is a front view of the outlet of a spigot in FIG. 4.
Figure 7:
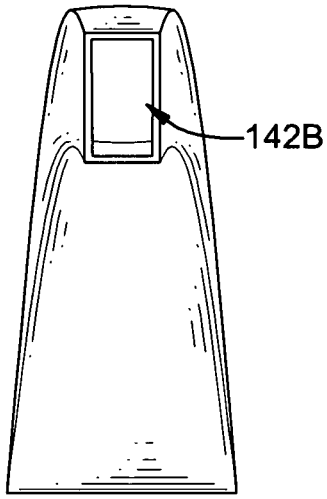
FIG. 7 is a front view of the outlet of a spigot in FIG. 6.

With reference to FIGS. 2, 5 and 7, the outlet hole (142, 142A, 142B) may have an inverted triangular shape or be rectangular, is formed through the front side of the head (13) and communicates with the flow passage (14) and has a width and a length. The width of the outlet hole (142, 142A, 142B) is defined along the top face of the neck (12). The length of the outlet hole (142, 142A, 142B) is defined along the sidewalls of the neck (12) and is wider than the width of the outlet hole (142, 142A, 142B).

Alternatively, with reference to FIGS. 4 and 5, the outlet hole (142A) further has an upper side, a middle, a lower side, a first opening segment (1421A), a second opening segment (1422A) and a third opening segment (1423A). The first opening segment (1421A) is rectangular, is formed in the upper side of the outlet hole (142A) and has a width. The second opening segment (1422A) is rectangular, is formed in the middle of the outlet hole (142A) and communicates with the first opening segment (1421A) and has a width narrower than the width of the first opening segment (1421A). The third opening segment (1423A) is rectangular, is formed in the lower side of the outlet hole (142A) and communicates with the second opening segment (1422A) and has a width narrower than the width of the second opening segment (1422A).

Figure 3:
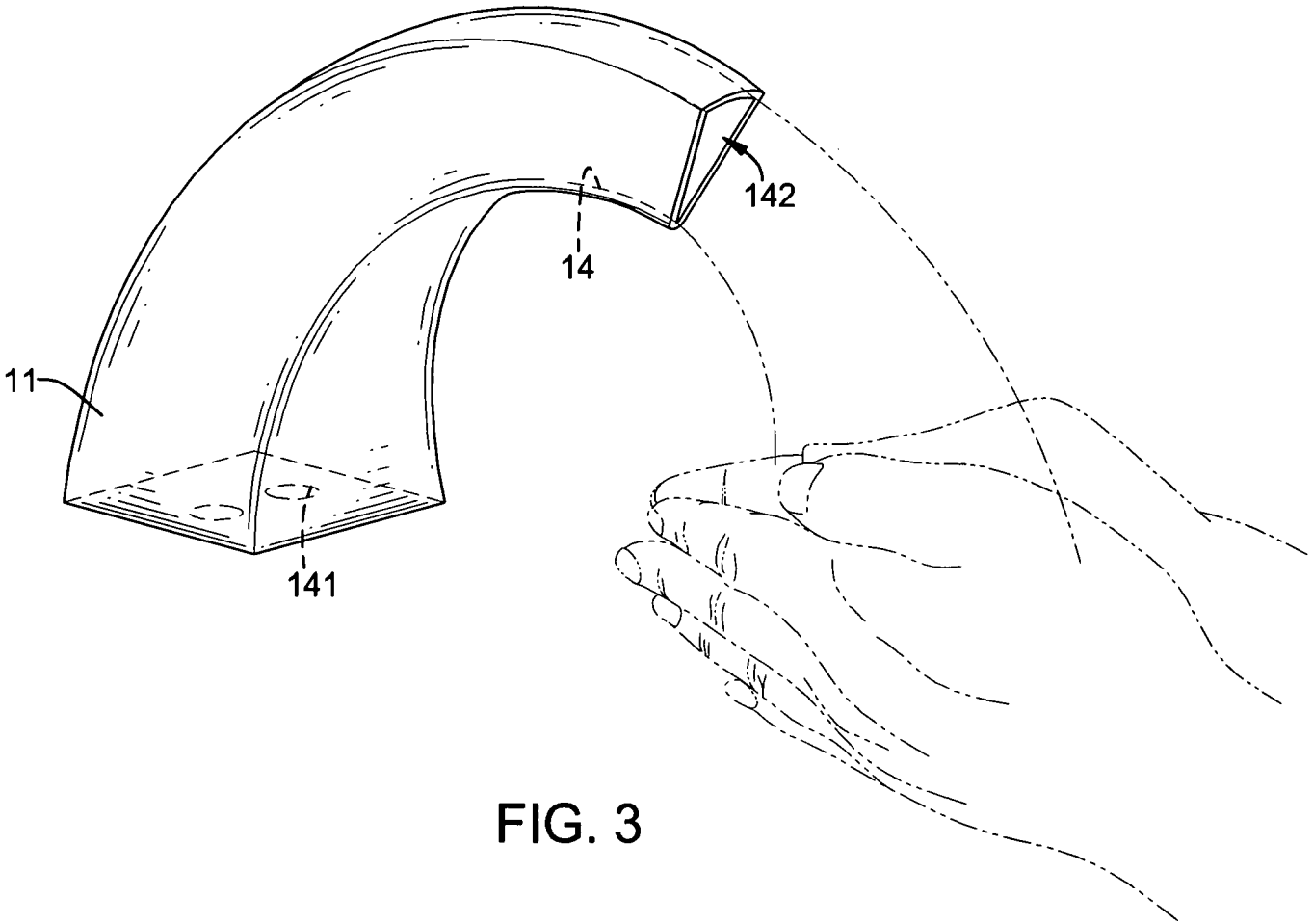
FIG. 3 is an operational perspective view of the outlet of a spigot in FIG. 1.

With reference to FIGS. 3, 4, and 6, when using the outlet (10) of a spigot in accordance with the present invention to wash hands, water flows into the flow passage (14) via the inlet hole (141) and flows out of the outlet (10) from the outlet hole (142, 142A, 142B). Because the length of the outlet hole (142, 142A, 142B) is wider than the width of the outlet hole (142, 142A, 142B), the water column sprayed out from the outlet hole (142, 142A, 142B) has a corresponding shape as the outlet hole (142, 142A, 142B). Consequently, water can spray on the whole hands and provide an excellent washing effect. In the same volume of water, the outlet hole (142, 142A, 142B) of the outlet (10) in accordance with the present invention can provide a preferred washing effect than that provided by the conventional circular or flat outlet of the conventional spigot. Furthermore, when the water pressure is increased, the shape of the outlet hole (142, 142A, 142B) can prevent the water column from spraying everywhere and this can reduce the waste of water Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An outlet of a spigot comprising:

a bottom seat having a flat bottom face with four sides;

a neck curvedly formed on and protruding upward from the bottom seat and having a top face formed on and protruding from one of the sides of the flat bottom face of the bottom seat;

two sidewalls respectively formed on and protruding from two of the sides of the flat bottom face of the bottom seat, formed with the top face of the neck and facing to each other; and a bottom face formed on and protruding from the other side of the flat bottom face of the bottom seat, formed with the sidewalls of the neck and being opposite to the top face of the neck;

a head formed on and protruding forward from the neck and having a front side formed with the top face, the sidewalls and the bottom face of the neck; and a flow passage formed in the outlet between the bottom seat, the neck and the head and having an inlet hole formed through the bottom face of the bottom seat and communicating with the flow passage; and an outlet hole having an inverted triangular shape, formed through the front side of the head and communicating with the flow passage, and the outlet hole having a width being defined along the top face of the neck; and a length being defined along the sidewalls of the neck and being wider than the width of the outlet hole.

2. An outlet of a spigot comprising:

a bottom seat having a flat bottom face with four sides;

a neck curvedly formed on and protruding upward from the bottom seat and having a top face formed on and protruding from one of the sides of the flat bottom face of the bottom seat;

two sidewalls respectively formed on and protruding from two of the sides of the flat bottom face of the bottom seat, formed with the top face of the neck and facing to each other; and a bottom face formed on and protruding from the other side of the flat bottom face of the bottom seat, formed with the sidewalls of the neck and being opposite to the top face of the neck;

a head formed on and protruding forward from the neck and having a front side formed with the top face, the sidewalls and the bottom face of the neck; and a flow passage formed in the outlet between the bottom seat, the neck and the head and having an inlet hole formed through the bottom face of the bottom seat and communicating with the flow passage; and an outlet hole formed through the front side of the head and communicating with the flow passage, and the outlet hole having an upper side;

a middle;

a lower side;

a first opening segment being rectangular, formed in the upper side of the outlet hole and having a width;

a second opening segment being rectangular, formed in the middle of the outlet hole and communicating with the first opening segment and having a width narrower than the width of the first opening segment; and a third opening segment being rectangular, formed in the lower side of the outlet hole and communicating with the second opening segment and having a width narrower than the width of the second opening segment;

wherein the widths are defined along the top face of the neck.

* * * * *